United States Patent [19]

Pahnke

[11] 4,070,489

[45] Jan. 24, 1978

[54] SHIPPING AND COUNTER DISPLAY PACKAGE FOR CANDY BARS

[75] Inventor: Otto Pahnke, Halle, Germany

[73] Assignee: August Storck KG, Halle, Germany

[21] Appl. No.: 705,628

[22] Filed: July 15, 1976

[30] Foreign Application Priority Data

July 21, 1975 Germany ..... 7523165

[51] Int. Cl.[2] ..... B65D 5/50

[52] U.S. Cl. ..... 426/115; 206/45.12; 206/45.18; 206/45.2; 426/87; 426/122; 426/124; 206/611

[58] Field of Search ..... 206/45.12, 45.18, 45.31, 206/45.21, 45.23, 45.2; 426/106, 115, 122, 124, 87; 229/51 TS

[56] References Cited

U.S. PATENT DOCUMENTS

| | | | |
|---|---|---|---|
| 769,915 | 9/1904 | Nostrand | 206/45.18 |
| 1,455,610 | 5/1923 | Haskell | 206/45.18 X |
| 1,503,161 | 7/1924 | Hornecker | 206/45.11 |
| 1,517,537 | 12/1924 | Daggett | 206/45.18 X |
| 1,657,942 | 1/1928 | Spaldo | 206/45.12 X |
| 2,020,876 | 11/1935 | Clark et al. | 206/45.12 |
| 2,085,649 | 6/1937 | Gluck | 206/45.12 |
| 2,152,079 | 3/1939 | Mott | 206/45.12 |
| 2,983,372 | 5/1961 | Amatel et al. | 206/45.12 X |
| 3,027,261 | 3/1962 | Samara | 426/113 |

FOREIGN PATENT DOCUMENTS

| | | | |
|---|---|---|---|
| 1,049,299 | 1/1959 | Germany | 206/45.12 |

*Primary Examiner*—Steven L. Weinstein
*Attorney, Agent, or Firm*—Max Fogiel

[57] ABSTRACT

A shipping and counter display package, particularly for chocolate bars, in which a carton is provided with a detachable section on its front side. This detachable section covers a crease line located on the bottom side of the package. Symmetrical with the crease line, there are provided in the carton, two slide-in cardboard trays holding a plurality of candy bars and having bent-up rims touching one another. A metal strip is attached on the inside of the rear of the package carton, and covers partially the crease line. The metal strip is connected to the package carton, and is used for holding the package in a display position. The metal strip may be made of sheet aluminum, and is pasted to the interior of the rear side of the package. The detachable section has a rectangular shape, and is located in relation to the crease line so that the candy bars of both trays are partially exposed after the detachable section has been removed.

10 Claims, 4 Drawing Figures

Fig. 4
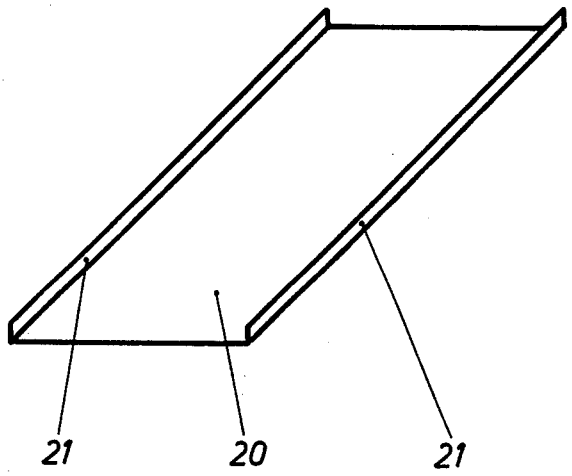
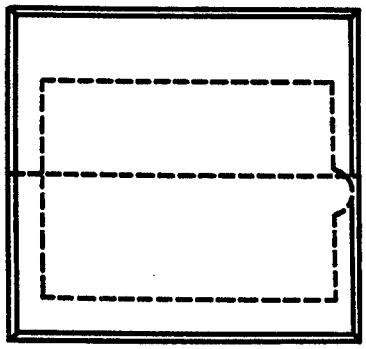
Fig. 2

SHIPPING AND COUNTER DISPLAY PACKAGE FOR CANDY BARS

BACKGROUND OF THE INVENTION

The present invention relates to a shipping and point-of-sale or counter display package for candy bars, particularly chocolate bars, with a package cardboard and on its front side a detachable section which covers the crease line located on the bottom side of the package.

Such a package which can be opened and installed for the removal of candy bars has become known in the art from German Utility Patent No. 1,886,455. It uses an enveloping package cardboard with cornered edges along whose periphery runs a closed perforation line which partially serves as tear-open and crease line. Because of the pronounced edgy shape of the package, it is impossible to know which side represents the front and which side represents the rear side. On the one side, there is located in the area of the perforation line a detachable section whose contour is also outlined by a perforated line. This section can be torn out so that the package content becomes more easily accessible. For example, the package is opened by tearing out the perforated section and, by folding the package sections connected along the crease line, is placed upon a surface, e.g., a table so that the candy bars can be individually removed in this position. It is found cumbersome in use that the display position is not fixed in any way, so that the package during the removal of a chocolate bar slides and returns to the flat position in which the chocolate bars get in each other's way due to their arrangement in the package cardboard. The known package designed as a 100 gram package contains eight chocolate bars, which are arranged in two groups of four bars each symmetrically around the crease line, with the narrow end facing one another.

A similar package has become known from German Utility Patent No. 1,988,559 which, however, has no detachable section. Adjacent to a continuous incision, are two perforated lines so that a flap is formed which can be torn open and bent over. The removal of the candy bars from this package is cumbersome.

It is, therefore, an object of the present invention to provide a shipping and counter display package of the initially described type which better serves its purposes during the opening and removal of candy bars. There must be the possibility of bending the package without difficulty, and to remove candy bars in the display position without running the risk that the package collapses into a flat condition.

Another object of the present invention is to provide a shipping and counter display package which may be readily assembled without requiring special skills.

A further object of the present invention is to provide a shipping and counter display package, as described, which may be economically fabricated.

SUMMARY OF THE INVENTION

The objects of the present invention are achieved by providing that symmetrically with the crease line, two slide-in cardboard trays with their bent-up rims adjacent to one another, are located in the package cardboard. On the inside of the rear side of the package cardboard, there is a metal reinforcing strip, partially covering the crease line and connected to the package cardboard, for holding the package in the display position. With these characteristics, one can create a package which accomplishes its purpose and which can hold 200 grams of candy bars. The arrangement of the slide-in cardboard trays, which in itself is already known in the art, with their bent-up rims symmetrical with the crease line, combines the two partial contents of the package into a closed group and gives this group of candy bars the required stiffness when folding the two package sections about the crease line. This characteristic favors the attainment of the final display position. The reinforcing metal strip is required to make the display position permanent. It involves the use of a material which, on the one hand, permits a permanent deformation, and, on the other hand, presents reaction forces which oppose a restoration to the flat position. This can be accomplished with a metal strip in the form of a thin tape section. For example, such a metal strip can be bent by folding the two package halves. Of course, during this folding, the metal strip also produces opposing forces. However, these forces can be overcome, because, due to the slide-in cardboard trays, the stiffness of each partial content of the package is increased, demonstrating the relationship between the improvements. Of course, the display position is retained till the package is intentionally returned to the flat position. In the display position, the individual bars can be removed with one hand because there is no danger that the package slides back to the flat position. The bent-up rims of the slide-in cardboard trays do not hinder the removal of the individual candy bars, because these bent-up rims can be easily moved to the opposite position during the removal of a candy bar.

The metal strip is preferably made of sheet aluminum and is glued to the inside of the package rear side. At that location, the metal strip is not detrimental in any manner. It hardly enlarges the dimensions of the package, and yet provides solid support to the package halves in the display position.

The detachable section on the front side is of rectangular shape, preferably postcard format, and is located in relation to the crease line so that the candy bars of both slidein cardboard trays are partially laid open after the section has been detached. Hence, the candy bars of both series of bars formed in this manner are easily accessible, and for removal the individual bar does not have to be moved.

The metal strip is partially weakened along the crease line, preferably by incisions, scoring, etc., so that, upon installing the package in the display position, the crease line, which coincides with the cut or scored line, can be developed without difficulty.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 2 shows top view of the closed and loaded package;

FIG. 4 shows a perspective view of a slide-in tray.

DESCRIPTION OF THE PREFERRED EMBODIMENTS

Figure 1:
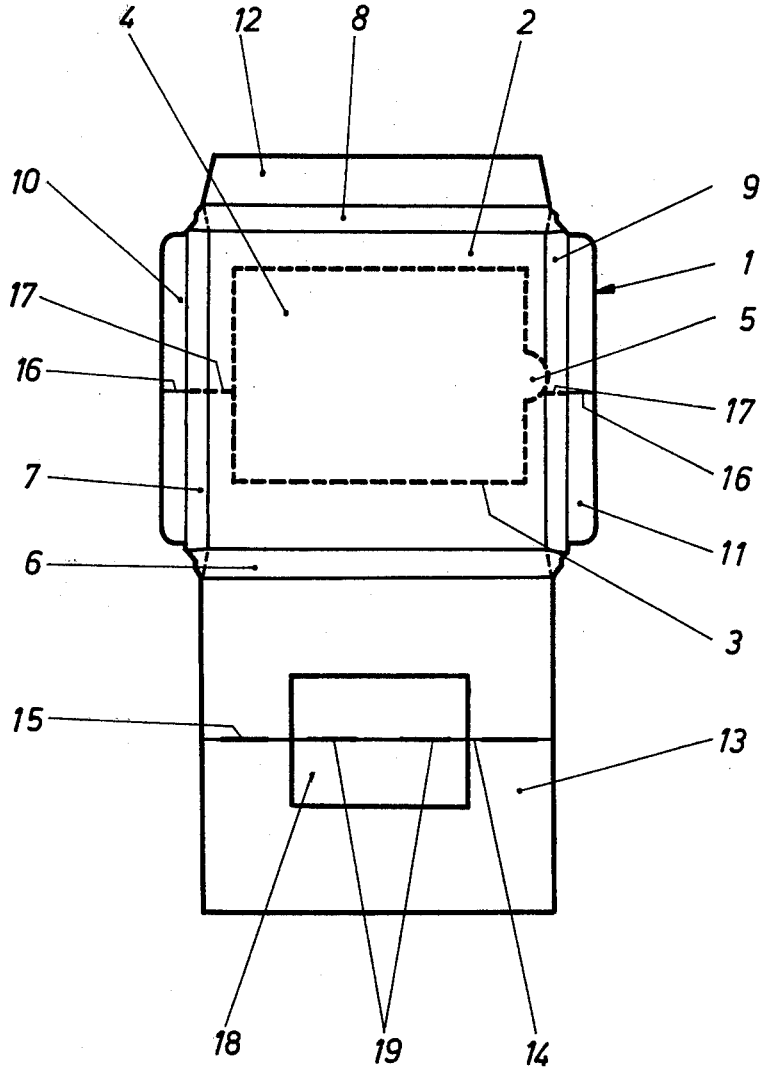
FIG. 1 shows a top view of the rear and inside of the display arrangement developed in one plane.

The cardboard 1 shown in FIG. 1 is intended for the display and dispensing of 200 grams of candy. It has a front side which has a closed perforation line 3 which encloses a detachable section 4. The perforation line 3 may have a design where one tab 5 is provided for starting the tear-out process or for locating the finger of the user. The front side 2 is connected to the oblique sidewalls 6, 7, 8 and 9 which are formed by scoring on the cardboard. Sidewalls 7 and 9 have flaps 10 and 11. Sidewalls 8 has tab 12, while sidewall 6 is connected to rear side 13 of the cardboard.

The rear side 13 is symmetrically divided by the crease line 14 which extends throughout the rear side 13. The crease line may be weakened by a perforation 15 or by scoring in order to facilitate the bending of the two package parts relative to each other. A corresponding weakening or scoring 16 is continued in the area of flaps 10 and 11. The detachable section 4 connects to a perforation line 17 on both sides, corresponding to crease line 14. This perforation line also extends to the sidewalls 7 and 9 and ends at the transition to the flaps 10 and 11.

The rear side 13, on the inside of the later assembled package, connects to a metal strip 18, for example, in the form of a pasted-on aluminum strip. The arrangement is such that both parts of rear side 13, formed by the crease line 14, are covered to the same extent by the metal strip 18. The metal strip also, corresponding to the crease line 14, may be weakened by incisions or scoring 19.

In assembling the package and the insertion of the candy, two slide-in trays 20 as shown in FIG. 4 are used. Each slide-in tray 20 has rims 21 which are bent up along its length dimensions, with eight candy bars being placed into the slide-in tray in such a way that their front sides contact the rims 21. The bottom surface of each slide-in tray 20 is, adapted to the bottom surface of the rear side 13 which is formed by crease line 14. The slide-in trays, loaded with candy bars, are then inserted into the package. The package 1 is closed so that the loaded and ready-to-ship package appears as shown in FIG. 2.

Figure 3:
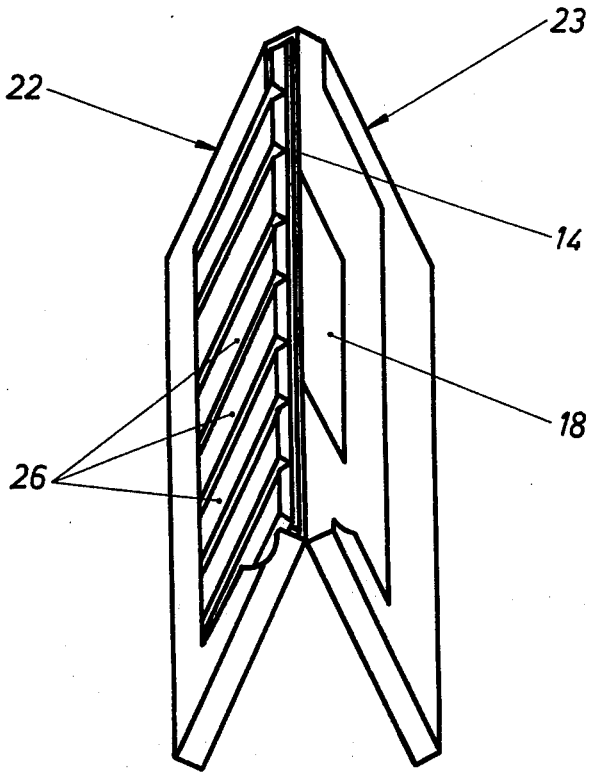
FIG. 3 shows a perspective view of the opened package in the display position.

To open the package, the consumer detaches section 4 with the detaching expediently starting with tab 5. Later, the two package parts 22 and 23 (see FIG. 3) are folded about the crease line 14, so that the package — in cross-section a V with the angle pointing upward — can be placed on a table. While bending (folding) the two package parts 22 and 23 apart around the crease line 14, the metal strip 18 or its two sections preformed by the crease line 14, are bent. The metal strip is, of course, not severed, but only undergoes plastic deformation. Hence, the metal strip 18 ensured the upright position, i.e., contact with and stresses on the package as customary with the subsequent removal of the candy bars, cannot result in departure from the display position of FIG. 3 and lying flat on the table. During the bending apart of the two package sections 22 and 23, the rims 21 and the slide-in trays 20 constitute a stiffener for the package sections 22 and 23 because they combine the enclosed candy bars into a merchandise block or merchandise group so that a simple displacement of the package sections about the crease line 14 is possible. During this process, the perforation line 17 on the front side and in the area of side walls 7 and 9 rips open. The two abutting rims 21 of the two slide-in trays 20 break contact so that the rims make an angle in the direction to the plane of the bottom of the slide-in tray. This does not impede the removal of the individual candy bars 14 in the folded position of FIG. 3. It is possible to grasp a candy bar 24 with one hand and to remove it from the set-up package without the package collapsing. Finally, it is of advantage that the package has no additional installation sections which must be attached or connected to various parts of the wall when the package is set up. The installed position is automatically established during the opening process, by bending the sheet metal strip and the resulting forces which oppose a counter-movement.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

I claim:

1. A shipping and counter display package for candy in bar form, particularly chocolate bars, a carton of said package having a crease line on the rear side of said package, a detachable section on the opposite front side of said package positioned over said crease line for partially exposing candy bars when said detachable section has been removed, slide-in cardboard trays holding a plurality of candy bars and having a bottom surface and having bent-up rims touching one another, said trays having their bottom surface resting on the inner surface of said rear side and being located symmetrical with said crease line in said carton, said bent-up rims being substantially parallel to said crease line, a metal strip on the interior of the rear side of the package carton and partially covering said crease line, said metal strip being connected to the package carton for holding the package in a display position; said slide-in trays stiffening the rear side of said package so that a substantially sharp fold is formed along said crease line when said package carton is bent to form said fold for placement of the package in a display position.

2. The shipping and counter display package as defined in claim 1 wherein said metal strip is comprised of sheet aluminum pasted to the interior of the rear side of said package.

3. The shipping and counter display package as defined in claim 1 including incision means on said metal strip for partially weakening said metal strip along said crease line.

4. The shipping and counter display package as defined in claim 1 wherein the cardboard of said package adjacent to said metal strip is substantially weakened along said crease line.

5. The shipping and counter display package as defined in claim 1 including scoring means on said metal strip for partially weakening said metal strip along said crease line.

6. The shipping and counter display package as defined in claim 1 wherein said metal strip is comprised of sheet aluminum pasted to the interior of the rear side of said package, said detachable section having a rectangular-shape in the form of a postcard and being located relative to said crease line so that candy bars on both slide-in cardboard trays are partially exposed after said detachable section has been removed, said metal strip being partially weakened along said crease line, the package cardboard adjacent to said metal strip being also weakened substantially along said crease line.

7. The shipping and counter display package as defined in claim 1 wherein said metal strip has a substantially rectangular shape and having a side parallel to said crease line substantially longer than the side normal to said crease line.

8. The shipping and counter display package as defined in claim 1 wherein said metal strip is comprised of sheet aluminum pasted to the interior of the rear side of said package, said detachable section having a rectangular-shape in the form of a postcard and being located relative to said crease line so that candy bars on both slide-in cardboard trays are partially exposed after said detachable section has been removed, said metal strip being partially weakened along said crease line, the package cardboard adjacent to said metal strip being also weakened substantially along said crease line, said metal strip having a substantially rectangular-shape with a side parallel to said crease line substantially longer than the side normal to said crease line, said slide-in cardboard trays comprising two trays, each tray having a bottom surface, said bent-up rims being substantially normal to said bottom surface of said tray, said bent-up rims being substantially parallel to said crease line, each tray having a bent-up rim substantially along said crease line and touching the adjacent bent-up rim of the other tray, said detachable section being surrounded by a border for holding the partially exposed candy bars when said detachable section has been removed.

9. The shipping and counter display package as defined in claim 1 wherein said detachable section is substantially rectangular-shaped and is located relative to the crease line so that the candy bars of both slide-in cardboard trays are partially exposed after said detachable section has been removed.

10. The shipping and counter display package as defined in claim 9 wherein said detachable section carries indicia adapting said detachable section for mailing as a postal card.

* * * * *